United States Patent [19]

Brann

[11] 4,040,695

[45] Aug. 9, 1977

[54] FLIP HANDLE

[76] Inventor: Dale A. Brann, 1600 N. Wilmot Road No. 213, Tucson, Ariz. 85712

[21] Appl. No.: 687,021

[22] Filed: May 17, 1976

[51] Int. Cl.[2] ..... A47B 88/00

[52] U.S. Cl. ..... 312/320; 16/112

[58] Field of Search ..... 312/234.0, 320, 330, 312/333, 112, 114 R, 114 B; 16/124 R, 135; 40/325; 190/58; 232/44-46

[56] References Cited

U.S. PATENT DOCUMENTS

| | | | |
|---|---|---|---|
| 3,107,389 | 10/1963 | Engelbrecht | 312/320 |
| 3,252,746 | 5/1966 | Kafferlin et al. | 312/320 |
| 3,338,649 | 8/1967 | Stewart | 312/320 |
| 3,389,854 | 6/1968 | Coopersmith | 232/46 |

FOREIGN PATENT DOCUMENTS

| | | | |
|---|---|---|---|
| 875,795 | 8/1961 | United Kingdom | 232/46 |

*Primary Examiner*—Casmir A. Nunberg
*Attorney, Agent, or Firm*—Cahill, Sutton & Thomas

[57] ABSTRACT

A recessed and flush mounted flip handle for cabinet doors, drawers and the like is formed of two interlocking extrusions.

5 Claims, 3 Drawing Figures

FLIP HANDLE

The present invention relates to pivotable handles and, more particularly, to recessed flush mounted flip handles.

Cabinets housing electronic equipment are generally constructed with a plurality of drawers wherein each drawer contains electronic equipment or modules of electronic equipment. Such segregation permits relatively facile repair and/or replacement of the drawer mounted equipment in toto or of a module mounted within the drawer. In the past, it has been common practice to attach vertically oriented U-shaped members at each lateral end of a drawer front, which members serve as handles for opening and closing or removing the drawers. Handles of this type necessarily increase the space requirements of the cabinet and add little or no aesthetic value.

To overcome the protruding prior art handles, various pivotable handles have been employed. Handles of this type are generally adequate for the purposes intended but usually require a multitude of parts; hence, they are subject to wear or malfunction rate increases in proportion to the parts count. Moreover, the requirement for multitudinous parts also tends to increase the cost of manufacture and assembly. A further type of handle employed has been that of an undercut ledge or ridge which could be engaged by an operator's fingers. Such a ridge is generally satisfactory for opening a drawer but provides inadequate means by which the drawer could be transported upon removal from the cabinet.

It is therefore a primary object of the present invention to provide a flip handle for drawers and the like.

Another object of the present invention is to provide a recessed flush mounted flip handle.

Yet another object of the present invention is to provide a flip handle mountable within any kind of drawer front.

Still another object of the present invention is to provide a flip handle having a base and an interlocking handle of extruded parts.

A further object of the present invention is to provide a flip handle mountable intermediate two supports by four rivets.

A yet further object of the present invention is to provide an inexpensive flip handle.

These and other objects of the present invention will become apparent to those skilled in the art as the description thereof proceeds.

The present invention may be described with greater specificity and clarity with reference to the following Figures, in which.

Figure 1:
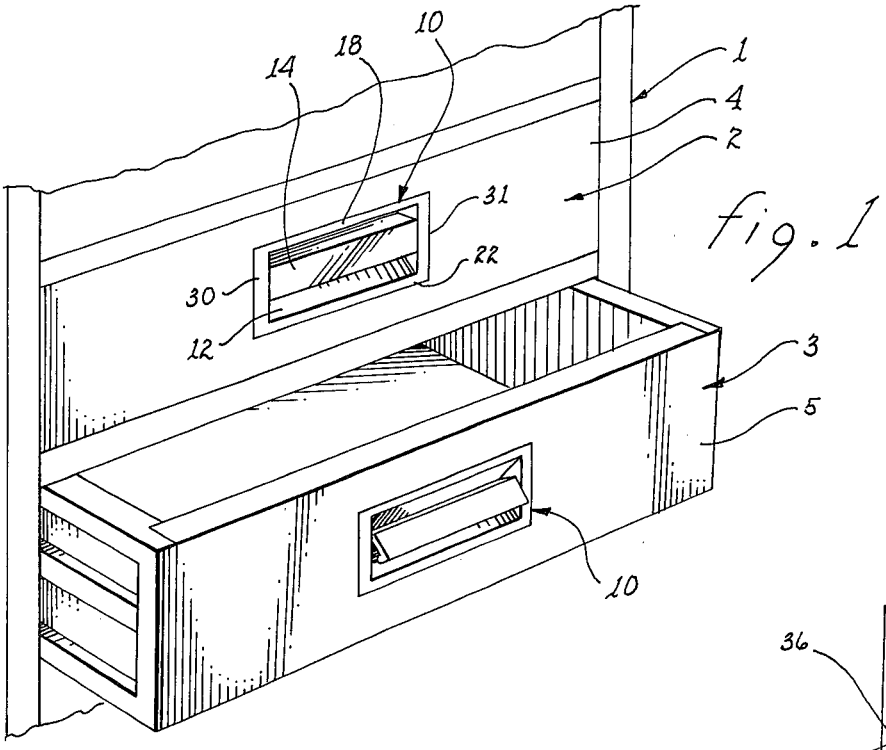
FIG. 1 is a perspective view of flip handles mounted within the fronts of cabinet drawers.

Referring to FIG. 1, there is illustrated a representative cabinet 1 having a plurality of drawers, such as drawers 2 and 3, mounted therein. Each face 4 and 5 of drawers 2 and 3, respectively, has mounted therein a flip handle 10 constructed in accordance with the teachings of the present invention. The flip handle is shown in the retracted position in drawer 2 to illustrate the flush mounting of the handle. Drawer 3, being partially extended, depicts the flip handle in the extended position as if it were being grasped by an operator intending to slide the drawer out of the cabinet.

Figure 2:
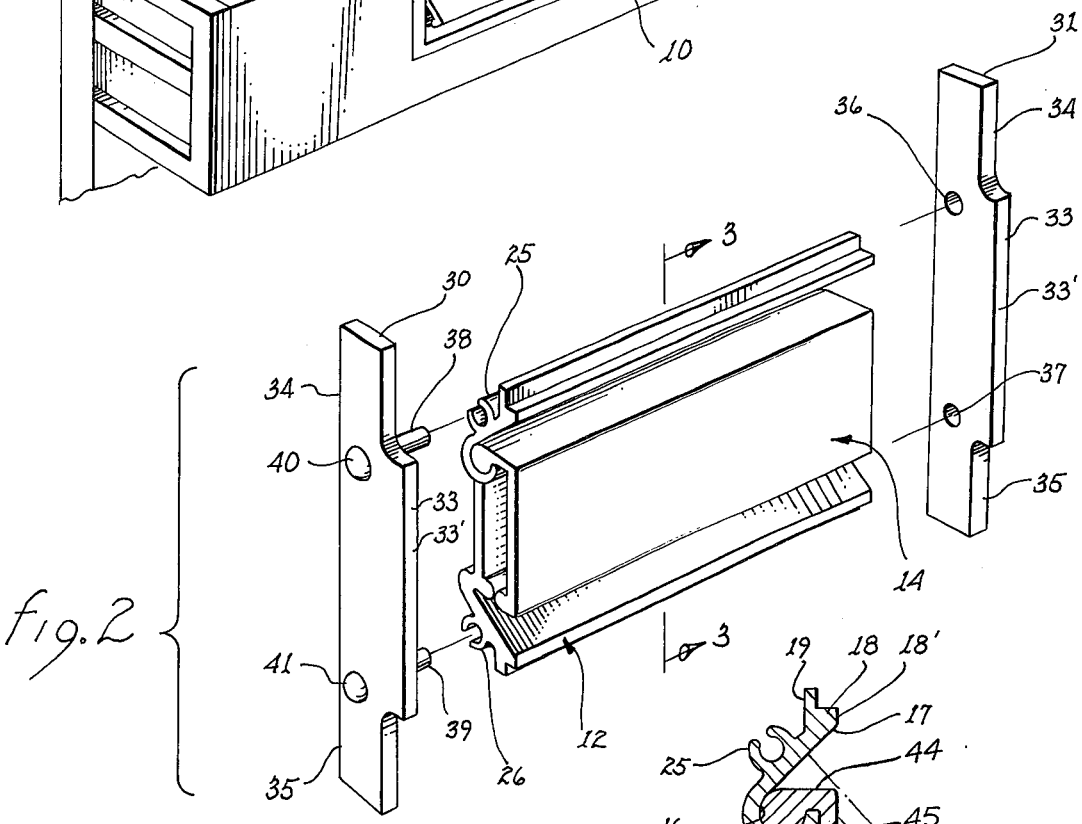
FIG. 2 is an isometric view of the components of a flip handle.

The details of the flip handle will be discussed with specific reference to FIGS. 2 and 3. Flip handle 10 is formed of two interlocking members, a base 12 and a handle 14. Base 12 is preferably formed as an extrusion having a channel 16 partially closed upon itself and defining a longitudinal segment of a cylinder. A flange 17 extends from one edge of channel 16 and is terminated by top 18' of a ridge 18. A longitudinal mounting support 19 may extend laterally from the base of ridge 18. A center section 20 extends downwardly from the exterior surface of channel 16 and terminates at a bumper 21. A further flange 22 extends from bumper 21 and terminates at the top 23' of a further ridge 23. Another longitudinal mounting support 24 may extend laterally from the base of ridge 23. Further channels 25 and 26, which are generally cylindrical in cross-section and partially closed upon themsleves, extend from the rear surfaces of flanges 17 and 22, respectively.

Referring momentarily to FIG. 1, it may be noted that the tops of ridges 18 and 23 are flush with face 4 of drawer 2 and that the remaining elements of base 12 are disposed within an appropriately configured recess or aperture within the drawer front.

A pair of vertical supports 30 and 31 are disposed at either side of base 12 and serve as the primary elements for retaining the base within the front of the drawer. Each support includes a raised center section 33 which terminates in a plane defined by the tops of ridges 18 and 23. The upper and lower legs 34 and 35 of the supports may be of any convenient length in order to establish a firm mechanical attachment or lock with the front of the drawer; or, if supports 30 and 31 are employed as side elements of the drawer in order to obtain a full width handle, legs 34 and 35 would be of a length sufficient to render supports 30 and 31 equivalent in height to the height of the drawer. A pair of apertures 36 and 37 are disposed with each of supports 30 and 31. These apertures are configured in size to receive the shank 38, 39 of rivets 40, 41, respectively. In the alternative, rods may be disposed within channels 25, 26 for engagement with supports 30, 31.

Where side located supports are not feasable, the base can be bolted or screwed to the bottom of a receiving cavity within a drawer front. Necessarily, the dimensional relationships between apertures 36, 37, channels 25 and 26, and the top of center sections 33 must be such that tops 18',23' of ridges 18 and 23 and the tops 33' of center section 33 are planar and flush with the face of the drawer.

Handle 14 is a generally L-shaped extrusion having a base leg 44 terminating at a longitudinally extended bulbous end 45. The bulbous end is partially circular in cross-section to pivotally mate with channel 16. The remaining leg 27 of handle 14 is terminated by a longitudinally oriented ridge 28 having a generally triangular cross-section. This ridge serves two purposes: first, it serves in the nature of an undercut to permit engagement by the fingers of an operator to pivotally raise the handle and pull the drawer toward him; second, the ridge, when the handle is in the retracted position, bears against bumper 21 to maintain the visible surface of the handle planar with the face of the drawer.

Figure 3:
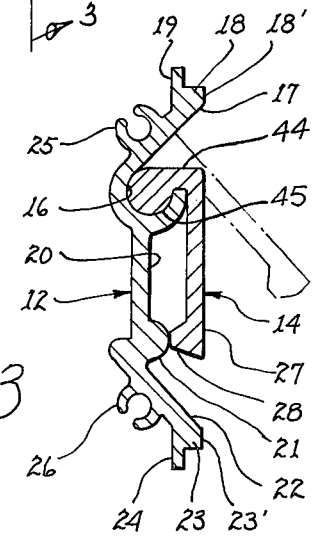
FIG. 3 is a cross-sectional view taken along lines 3—3, as shown in FIG. 2.

As depicted in phantom lines in FIG. 3, when handle 14 is pivotally raised, the base leg pivots within channel 16 until the planar surface of the base leg contacts the planar surface of flange 17. Further upward pivotal movement is thereby impeded and full force may be applied to the handle to pull out the drawer. Necessarily, the allowable tolerances intermediate bulbous end 45 and channel 16 must provide sufficiently low friction to permit the weight of the handle to urge downward pivotal movement of the handle to the retracted position when the handle is released.

The spacing intermediate ridge 28 and the upper surface of flange 22 must be sufficient to permit an operator's fingertips to intrude therebetween and pivotally raise the handle to its operating position.

In summary, the flip handle of the present invention is developed from a specially extruded base 12 for interlockingly and pivotally supporting a specially extruded handle 14. The base may be attached to a drawer front by means of mounting supports 19 and 23 or by means of vertical supports 30 and 31 embedded within the drawer front and riveted to base 12.

Although the present invention was developed to meet a need related to cabinets for housing electronic equipment, the flip handle may be used in furnishings, such as desks, bureaus, other cabinets, etc. Moreover, the aesthetic value of the flip handle may be enhanced by anodizing the extrusions, if of aluminum or with paint. The width of the handle may be arbitrarily selected to accommodate both practical and aesthetic requirements.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A flip handle for drawer fronts and the like, said flip handle comprising in combination:

a. a pair of supports for securing said flip handle to the drawer;

b. a base for mounting said flip handle within the drawer front intermediate said pair of supports, said base including a channel partially closed upon itself and having a cross-section defining an arc;

c. a handle positionally pivotable from a first position flush with the face of the drawer to a second position, said handle in mechanical engagement with said base, said base leg having a bulbous edge with a cross-section defining a longitudinal segment of a cylinder commensurate with the arced section of said channel for retainingly engaging said channel;

d. a bumper disposed upon said base for restricting downward pivotal movement of said handle and defining said first position of said handle; and e. a flange extending from said channel for interferingly contacting said base leg and restricting upward pivotal movement of said handle and defining said second position of said handle;

whereby, said base retains said handle while accommodating pivotal movement of said handle with respect to the drawer front.

2. The flip handle as set forth in claim 1 wherein said handle includes a ridge for contacting said bumper to position said handle in said first position.

3. The flip handle as set forth in claim 2 further including:

a. channel means disposed within said base;

b. aperture means disposed within each of said pair of supports; and c. rivet means disposed within said aperture means for engaging said channel means to secure said base to said pair of supports.

4. The flip handle as set forth in claim 3 wherein said base and said handle are extruded elements.

5. The flip handle as set forth in claim 4 wherein said base and said handle are of equal longitudinal length.

* * * * *